United States Patent [19]

Watanabe

[11] Patent Number: 4,830,419

[45] Date of Patent: May 16, 1989

[54] DISPOSABLE ANIMAL WASTE COLLECTOR

[76] Inventor: Eric R. Watanabe, 150 Allen Ave., Apt. R, Glendale, Calif. 91201

[21] Appl. No.: 138,573

[22] Filed: Dec. 28, 1987

[51] Int. Cl.[4] ..... A01K 29/00; E01H 1/12

[52] U.S. Cl. ..... 294/1.3; 15/104.8; 15/257.6; 294/55

[58] Field of Search ..... 294/1.3–1.5, 294/11, 50.8, 50.9, 55; 15/104.8, 257.1, 257.2, 257.6, 257.7, 257.9; 206/223, 496; 220/345, 350, 351

[56] References Cited

U.S. PATENT DOCUMENTS

| | | | |
|---|---|---|---|
| 2,317,688 | 4/1943 | McDonald | 294/55 X |
| 3,286,826 | 11/1966 | Stoll | 294/1.3 |
| 3,971,503 | 7/1976 | Allan et al. | 294/1.3 |
| 4,215,888 | 8/1980 | Gavin et al. | 294/1.3 |
| 4,272,116 | 6/1981 | Tufte | 294/1.3 |
| 4,752,093 | 6/1988 | Haber et al. | 294/1.3 |

*Primary Examiner*—Johnny D. Cherry

*Attorney, Agent, or Firm*—Knobbe, Martens, Olson & Bear

[57] ABSTRACT

A collapsible, disposable scoop and housing, suitable for disposing of pet waste, is disclosed. An integral handle extends and retracts the scoop with respect to the housing. The extended scoop is used to pull waste within the housing, where it is secured by means of a sealing lip on the scoop and a locking tab on the handle.

15 Claims, 4 Drawing Sheets

Fig. 1
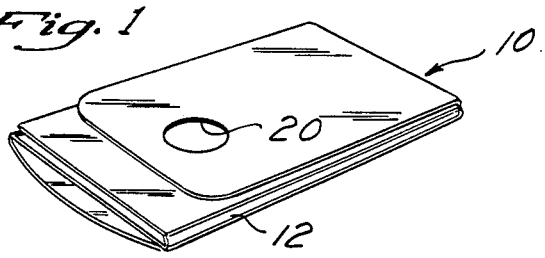
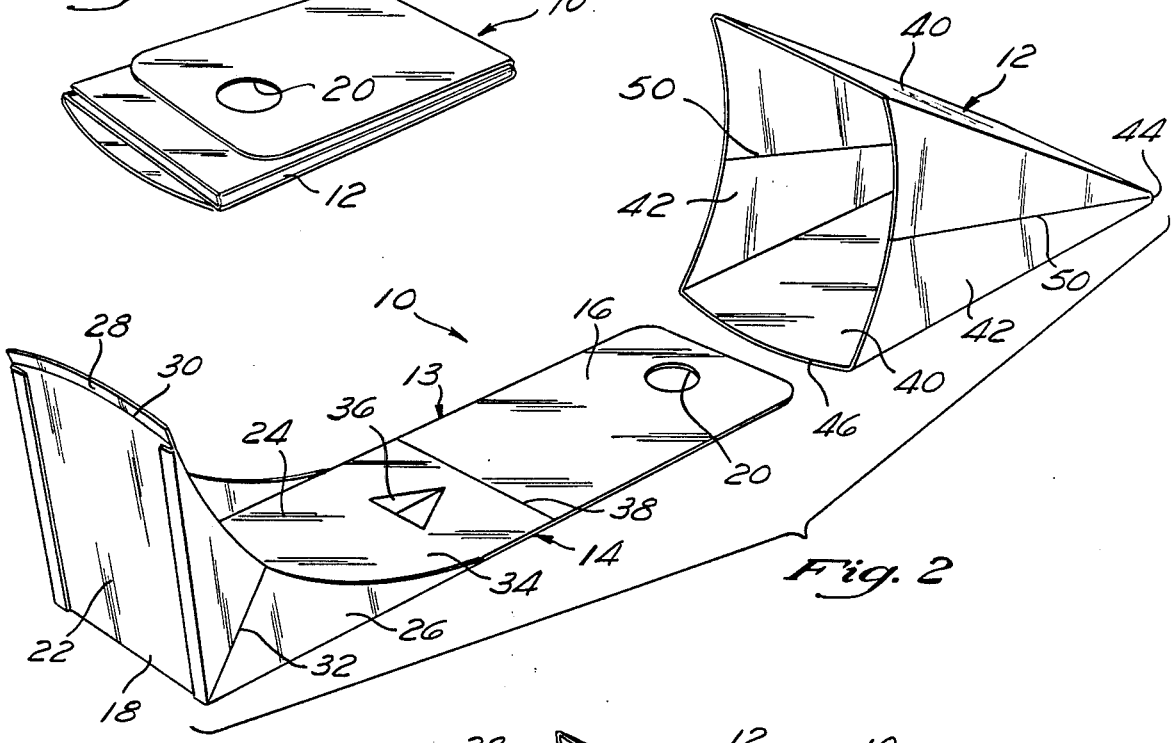
Fig. 2
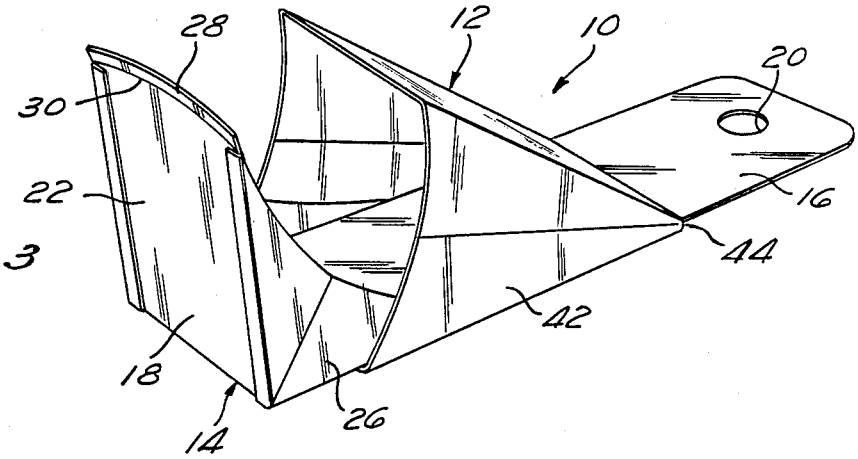
Fig. 3
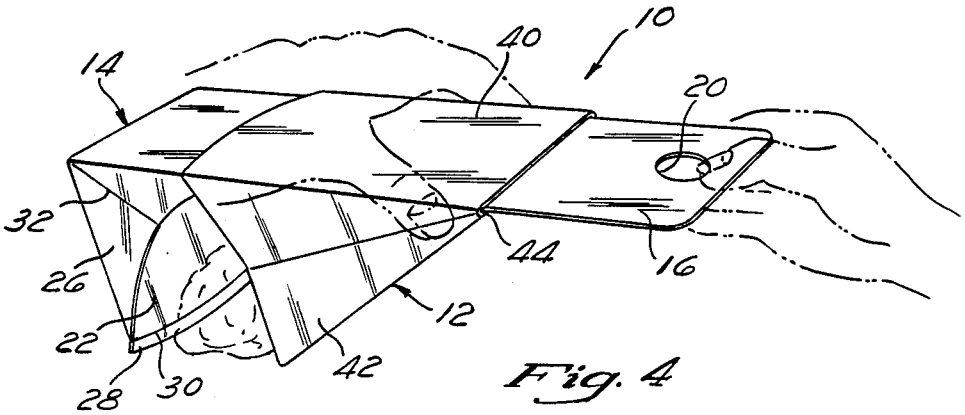
Fig. 4

Fig. 14
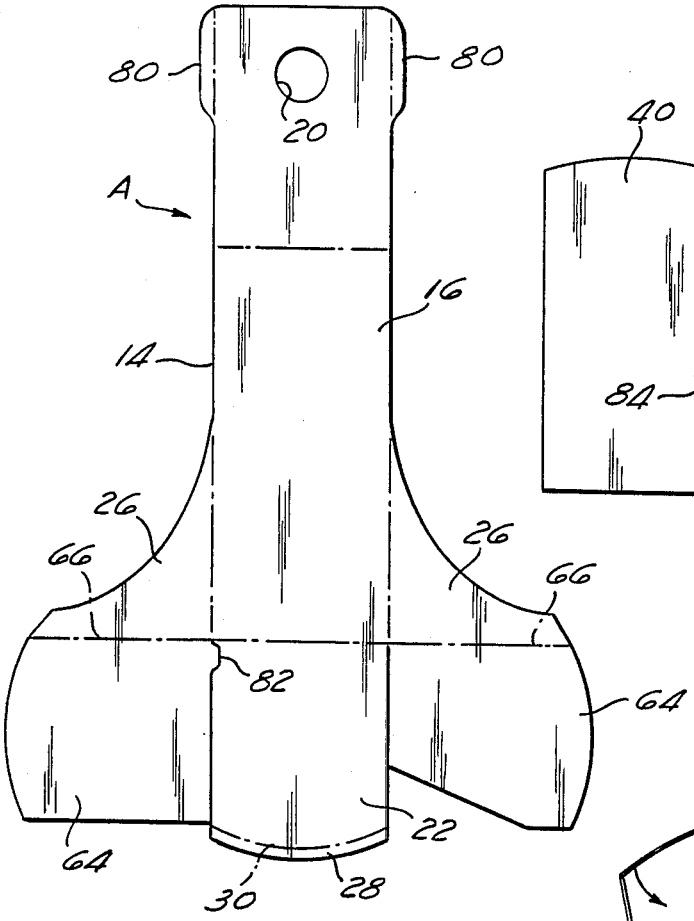
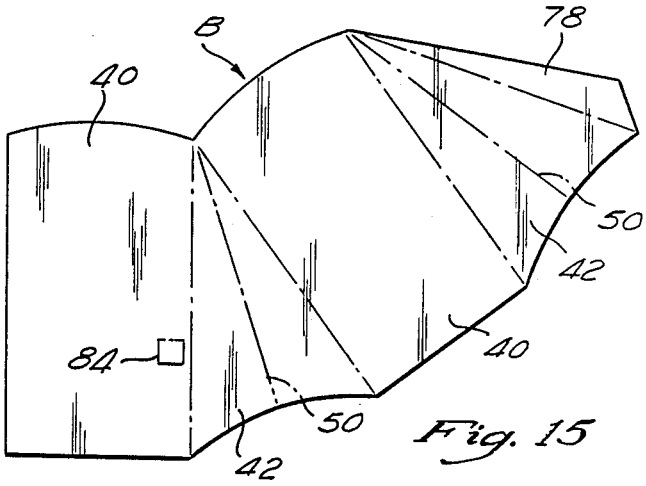
Fig. 15
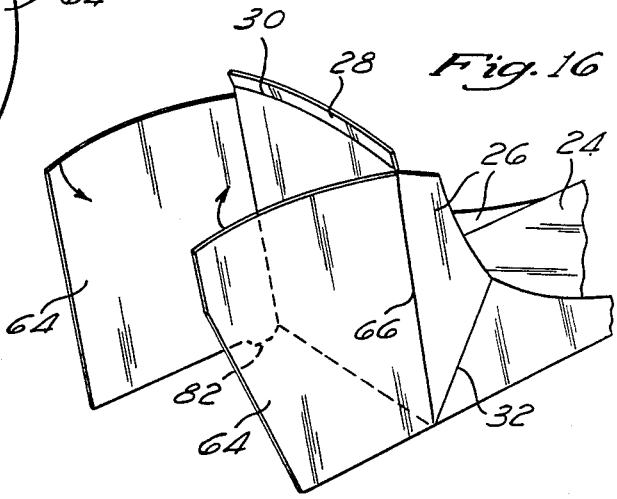
Fig. 16
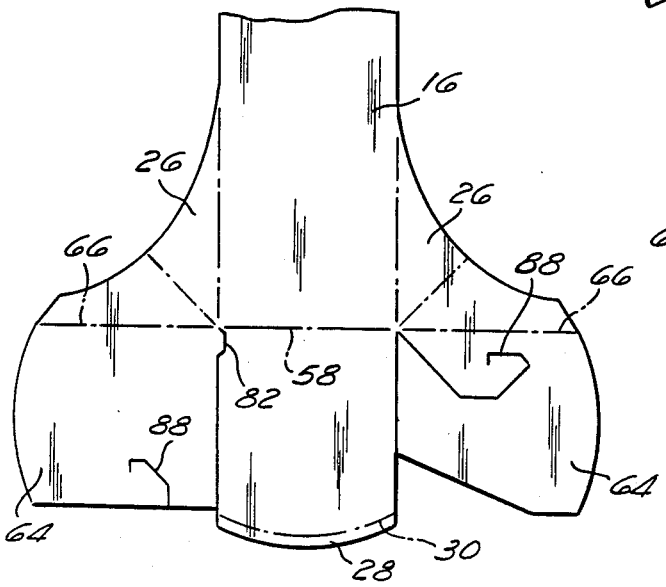
Fig. 17
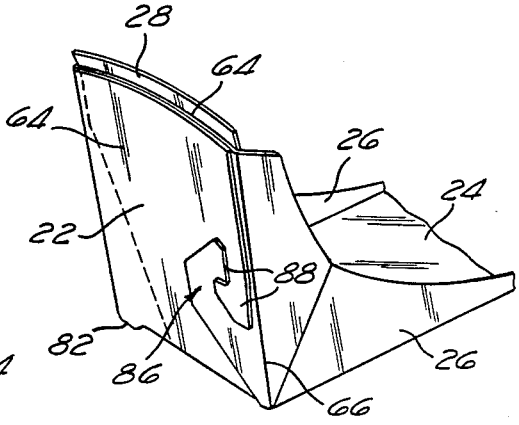
Fig. 18

DISPOSABLE ANIMAL WASTE COLLECTOR

BACKGROUND OF THE INVENTION

The present invention relates to devices for the owners are commonly faced with the task of picking up pet waste and want to perform the chore in the most aesthetic and sanitary way possible. An appropriate device should meet several criteria. First, since a collection device is frequently needed when the pet and owner are away from home, it should preferably be compact and portable. Also, to dispose of the collected waste in a way that will minimize odor and the contamination of the public trash facilities, the collected waste should be encased and sealed. From an aesthetic standpoint, it is preferable to use a collection device which the operator can manipulate remotely, at arm's length, so as to avoid manual transfers and the possibility of touching the waste or even the container itself. Further, the device should be one which is completely disposable.

Prior devices have attempted to meet these criteria. The waste collector disclosed in U.S. Pat. No. 4,247,139 allows the user to pick up and seal the waste in a disposable container without touching either the waste or the container. However, it is operated by a mechanical handle set in a frame, and the major part of the device is bulky and non-disposable. Another device disclosed in U.S. Pat. No. 3,971,503 represents a completely disposable collection device which eliminates direct contact between the operator and the waste. However, because it lacks a handle and cannot be operated remotely, the person using this device must hold the waste collector itself.

Accordingly, it is an object of the invention to provide a convenient, inexpensive device for collecting and disposing of unpleasant solid waste in the most aesthetic and sanitary way.

SUMMARY OF THE INVENTION

In accordance with the foregoing objects, the present invention provides a completely disposable, collapsible animal waste collecting device which allows the user to collect and contain the waste without direct contact with either the waste or even the container for the waste.

In this case, the present invention is completely portable, and can easily be stored in a pocket or purse. In its unfolded state, the device is quick, simple, and efficient to use, and is completely disposable.

The collecting device comprises a body and a sleeve, open at both ends, for housing the body. The body comprises an elongated panel folded at its lower end to form a scoop. Integral side walls hold the scoop in an open position during its use, and fold inwardly to allow the scoop section to fold flat against the body section for storage. The housing sleeve comprises a pair of planar panels connected by triangular gussets. The gussets extend to expand the lower end of the housing sleeve, forming a wedge shape, and fold inwardly to allow the sleeve to fold flat. The sleeve in its folded position slips over the folded body and in its expanded position slips over the extended body so as to house the body before and after use.

In accordance with another aspect of the invention, the upper section of the elongated panel of the body of the device extends through the open upper end of the sleeve to provide a handle. In one embodiment, the upper section has a hole therethrough to facilitate its use. In operation, the handle acts to extend the scoop forward and out of the sleeve in order to collect and retract the scoop up into the sleeve after use. In one embodiment, the handle has lateral ears that limit its forward movement through the sleeve.

In accordance with yet another object of the invention, the body and the sleeve are adapted to interlock with one another to restrict relative motion therebetween so that the contents are held securely within. In one embodiment, a punchout section on the upper section of the body engages the upper edges of the sleeve. In another embodiment, a tab extending from the base of the scoop engages an edge of a pop-out window on the upper planar panel of the housing sleeve. The base of the scoop has a terminal lip which acts as a friction seal when the scoop is retracted into the sleeve in the open condition.

The accompanying drawings show a collapsible, disposable device for collecting animal waste in accordance with preferred embodiments of the present invention.

BRIEF DESCRIPTION OF THE DRAWINGS

FIG. 1 is a perspective view of the device in an assembled, folded condition.

FIG. 2 is an exploded view of the device in a disassembled, unfolded condition.

FIG. 3 is a perspective view of the assembled, unfolded device with the body extended from the housing in position to be used.

FIG. 4 is a perspective view of the device in operation.

FIG. 14 is a planar view of the blank from which the body is formed in an alternate embodiment of the collecting device.

FIG. 15 is a planar view of the blank from which the housing sleeve is formed in an alternate embodiment of the collecting device.

FIG. 16 is a fragmentary view of the base of the scoop formed from the blank of FIG. 14.

FIG. 17 is a planar view of the lower section of the blank of FIG. 14 modified to form an integral interlocking support.

FIG. 18 is a fragmentary view of the base of a scoop formed from the blank of FIG. 17.

DETAILED DESCRIPTION OF THE INVENTION

Figure 5:
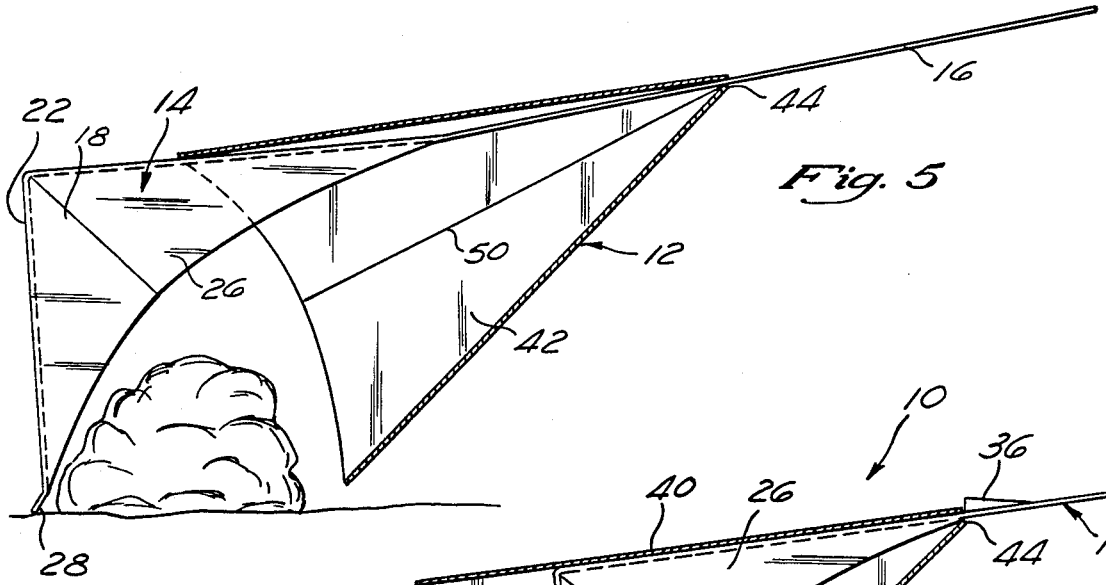
FIG. 5 is a planar side view of the device in operation.

FIGS. 1, 2 and 3 show a preferred embodiment of the invention which is a collapsible disposable animal waste collector 10 comprising two components, a body 14 and a housing sleeve 12. FIG. 1 shows the collector with the assembled components in a collapsed, folded state prior to use.

FIG. 2 shows in detail the features of each of the components of the embodiment. The body 14 has an upper section which serves as an integral handle 16 and a lower section which serves as a scoop 18. In a preferred embodiment, the handle 16 has a hole 20 punched at midpoint in the upper section to facilitate its use and also to hang the device for storage or display. The base 22 of the scoop 18 is at an approximately 90° angle to the back 24 of the scoop 18 and is held in that position by side walls 26. The side walls 26 are substantially triangular in shape with the apex of the triangle coincident with the angle between the base 22 and back 24 of the scoop 18 and two adjacent edges of the triangle contiguous with the side edges 26 of the scoop 18. The base 22 of the scoop 18 terminates in a lip 28 which is flexible along a fold line 30. In an alternate embodiment, the flexible lip 28 curves slightly outward.

The sleeve 12 has a wedge-shaped contour and comprises a pair of rectangular panels 40 connected by a pair of triangular gussets 42. The dimensions of the lower open end of the sleeve 12 are slightly larger than the dimensions of the base 22 of the scoop 18; the upper open end of the sleeve 12 is a narrow slit 44 between the two planar panels 40. In one embodiment seen in FIGS. 2 and 3, the free edges of the side walls 26 of the scoop 18 curve downwardly to form an arcuate boundary. The lower edges of the triangular gussets 42 of the housing sleeve 12 curve upwardly in a corresponding arc. The handle 16 of the body 14 is inserted through the lower end of the housing sleeve 12 and passes through the narrow slit 44 at its upper end. In this position, it serves to manipulate and operate the scoop 18, and also to pull the body 14 up into the housing sleeve 12. In an alternate embodiment seen in FIGS. 10 and 11, the sides of the handle 16 extend in lateral ears 80 which limit the forward extension of the body 14.

For convenient transportation and storage the entire device may be folded flat. The body 14 is flattened by folding the side walls 26 of the scoop inwardly along a bisecting crease 32 thus allowing the base 22 of the scoop 18 to fold up parallel with the plane of the body 14. The housing sleeve 12 is flattened by folding the triangular gussets 42 inwardly along the bisecting crease 50. The handle 16 of the body extending out through the narrow slit 44 at the upper opening is used to pull the body 14 up within the housing sleeve 12 and is then folded forward.

Among the features that contribute to the foldability and the compact profile of the folded device are the low cut arcuate-shaped side walls 26 of the scoop 18 which minimize the bulk of the scoop 18 and allow the base 22 to fold quite flat along the length of the body 14. Another such feature is the wedge-shaped design of the housing sleeve 12 based on the triangular gussets 42 of its side panels. Due to this design, the top of the housing sleeve 12 is 2-dimensional whether it is open or folded. It inherently lacks bulk and tends to urge the entire housing sleeve 12 into a folded state.

To open the device from its folded storage position of FIG. 1, the rectangular panels 40 of the sleeve 12 are pressed apart with one hand and the handle 16 is operated using the other hand to push the scoop 18 section forward and out of the housing sleeve 12. The base 22 of the scoop 18 is pulled to an erect position.

Figure 6:
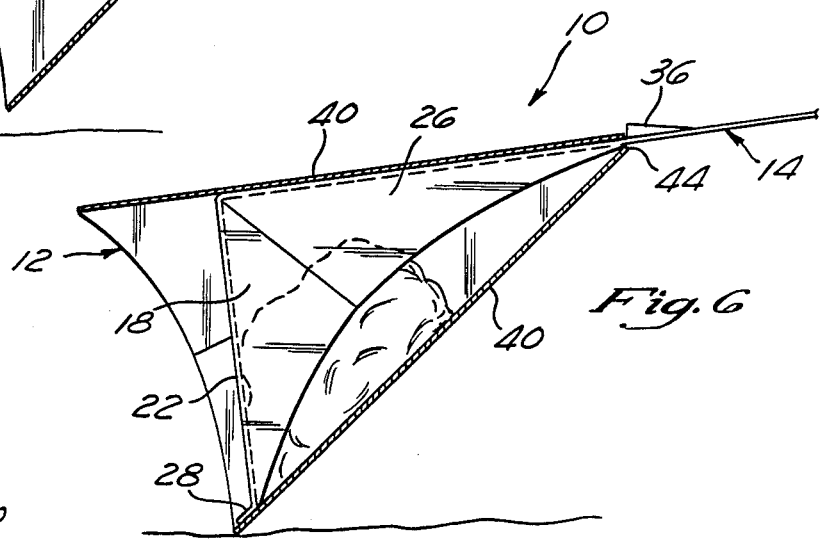
FIG. 6 is a planar side view of the device after use.

The use of the collector is illustrated in FIGS. 4 and 5. The scoop 18 is positioned over the pet waste, facing down, so that the base 22 of the scoop and its side walls 26 on one side and the lower rectangular panel 40 and triangular gussets 42 on the other can act as a pair of jaws. The handle 16 is pulled back through the sleeve 12 with one hand while the top of the housing sleeve 12 is held with the other hand. The base 22 of the scoop 18 acts to rake the waste into the housing sleeve 12, while the side walls 26 and triangular panels 42 act to keep the waste from spilling over to the side by directing it upward and centrally. As the scoop 18 moves up into the housing sleeve 12, it reaches a point at which the back 24 and side walls 26 of the scoop and the panels 40 and gussets 42 of the housing sleeve 12 are flush on three sides, and the terminal lip 28 of the scoop 18 makes a friction seal with the other wall 40 of the housing sleeve 12. At this point, as illustrated in FIG. 6, the waste is contained securely within the housing sleeve 12. A triangular punchout 36 is then pressed to extend a pair of wings from the body panel 14 out over the upper edge of the housing sleeve 12, locking it in place to prevent the scoop 18 from moving back down. The entire device is now disposed of.

Structures of the body 14 and housing sleeve 12 interact to provide efficient containment of the waste and associated odor. Examples are the complementary design of the handle 16 and housing sleeve 12, the triangular gussets 42 and the side walls 26 of the scoop 18, and the flexible lip 28 of the scoop 18 with the planar panel 40 of the housing sleeve 12.

The handle 16 of the body 14 when inserted through the narrow slit 44 of the upper open end of the housing sleeve 12 (as best seen in FIG. 4) forms a seal or barrier to odors which may come from the contained waste. In a preferred embodiment illustrated in FIG. 11, the edges of the slit 44 are curved outwardly to enhance the sealing effect. Since the handle 16 will tend not to fold or crease along a curved line, this design holds the handle 16 upright, a position in which it forms the most effective barrier.

The side walls 26 of the scoop and the triangular gussets 42 of the housing sleeve 12 cooperate to collect the waste efficiently and to package it securely. The arcuate lower boundaries of the triangular gussets 42 and the side walls 26 of the scoop 18 oppose each other, and as the scoop 18 is drawn into the housing sleeve 12 by its handle 16 (as best seen in FIG. 5), the arcuate edges pass each other in a scissors-like fashion. The edges of the triangular gussets 42 act to strip debris from the edges of the scoop side walls 26 and divert it into the path of the scoop 18 while at the same time acting to guide and facilitate the passage of the side walls 26 as the scoop 18 enters and move up into its housing sleeve 12.

Finally, the terminal flexible lip 28 of the scoop 18 acts as a friction seal against the planar panel 40 of the housing sleeve 12. As shown in FIG. 6, the length of the base 22 is slightly greater than that of the mouth of the housing sleeve 12, such that the flexible lip 28 is wedged within when the scoop 18 is drawn into the housing sleeve 12. This wedging action forms a secure friction seal which counteracts any tendency of the collector 10 to come open and dislodge its contents. Further, the terminal flexible lip 28 of the scoop 18 and the lower edge of the lower planar panel 40 of the housing sleeve 12 are matched in contour.

Figure 11:
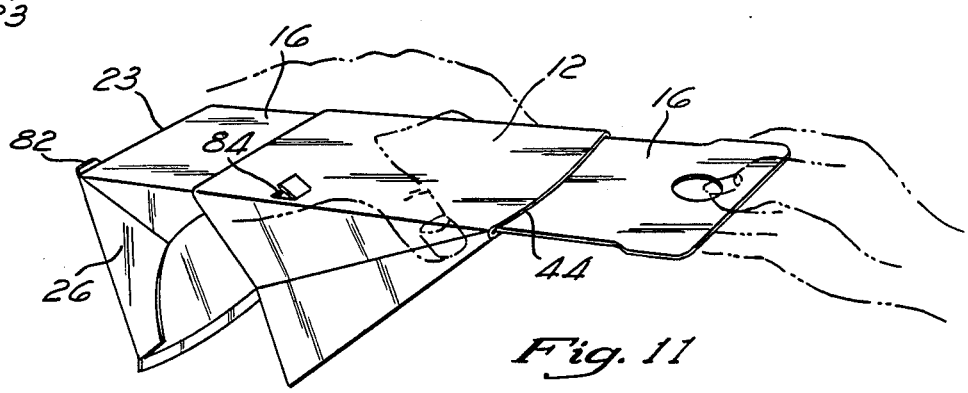
FIG. 11 is a perspective view of an alternate embodiment of the device in an assembled, unfolded condition with the body extended from the housing sleeve in position to be used.

In an alternate embodiment seen in FIGS. 3, 4 and 5, both the flexible lip 28 and the lower edge 46 of the planar panel 40 curve slightly outward. In this way the terminal lip 28 meets the lower edge 46 of the housing sleeve 12 simultaneously at all points so that the refuse burden of the scoop 18 will not be diverted laterally or below. In the operation of the scoop 18, the terminal flexible lip 28 folds back, and the folded edge 30 of the scoop so formed acts as a blade scraping a surface and undercutting the bulk of refuse to be collected. The lip, best as seen in FIGS. 5 and 11, trails the blade so as to wipe the surface clean. Refuse that piles up within the scoop 18 during this operation is directed centrally and upward within the barriers provided by the side walls 26 of the scoop 18 and the triangular gussets 42 of the housing sleeve 12. Once the scoop 18 is pulled up into the housing sleeve 12, the lower edge 46 of the lower planar panel 40 of the housing sleeve 12 covers and seals the soiled surface of the terminal flexible lip 28.

After the collection process, cooperative locking mechanisms between body 14 and housing sleeve 12 ensure that the scoop 18 and its contents are securely retained. In one embodiment, a triangular punchout 36 lies at the junction of the handle 16 and the scoop 18. To operate this lock, the handle 16 is used to pull the scoop 18 up into the housing sleeve 12 until the base of the punchout triangle 36 appears just above the upper edge 44 of the housing sleeve 12. The triangular section 36 is then pushed out, breaking the perforations along the base and midline and folding out a pair of wings along crease lines to extend above the slit 44 of the upper edge of the housing sleeve 12 so that the handle 16 cannot move down within it.

Figure 12:
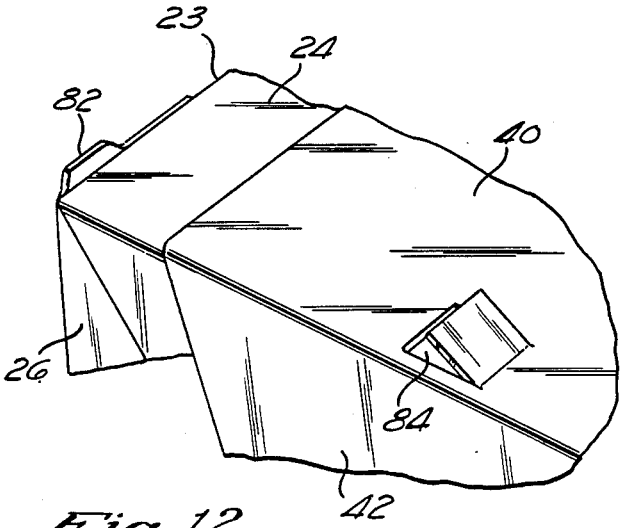
FIG. 12 is an enlarged fragmentary view of the upper face of an alternate embodiment of the device showing the tab and slot components of a punchout locking mechanism in an open condition.
Figure 13:
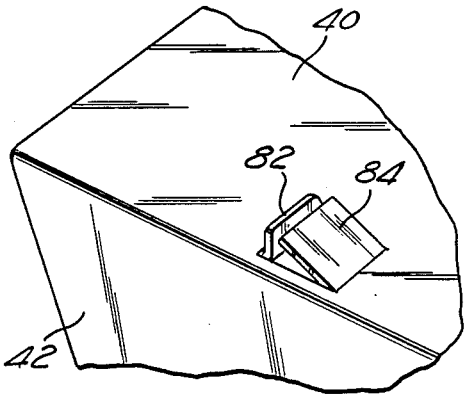
FIG. 13 is an enlarged fragmentary view similar to FIG. 12, but showing the tab and slot components of a punchout locking mechanism in a locked condition.

In an alternate embodiment, seen in FIGS. 12 and 13, a tab 82 extends from the back 24 of the scoop 18 in the vicinity of the angle 23 formed by the base 22 and the back 24 of the scoop 18. This tab 82 is designed to catch in a window 84 cut in the upper planar panel 40 of the housing sleeve 12. To operate this lock, the scoop 18 is pulled up into the housing sleeve 12 until the tab 82 snaps up into the window 84 and is held against the window's lower edge. When locked in place by either of these mechanisms, the scoop 18 is snugly fitted within the housing sleeve 12, with the back 24 of the scoop, the side walls 26 and the surface of the terminal lip 28 flush with its interior surfaces. Because of this sealed enclosure of the contents, odor leaking from the collection device is minimized.

Figure 8:
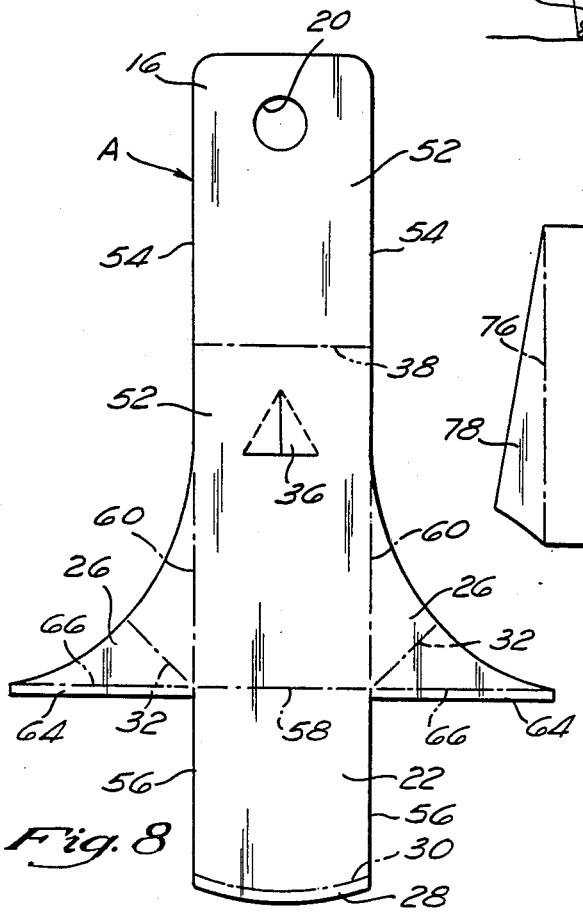
FIG. 8 is a planar view of the blank from which the body of the collecting device is formed.
Figure 9:
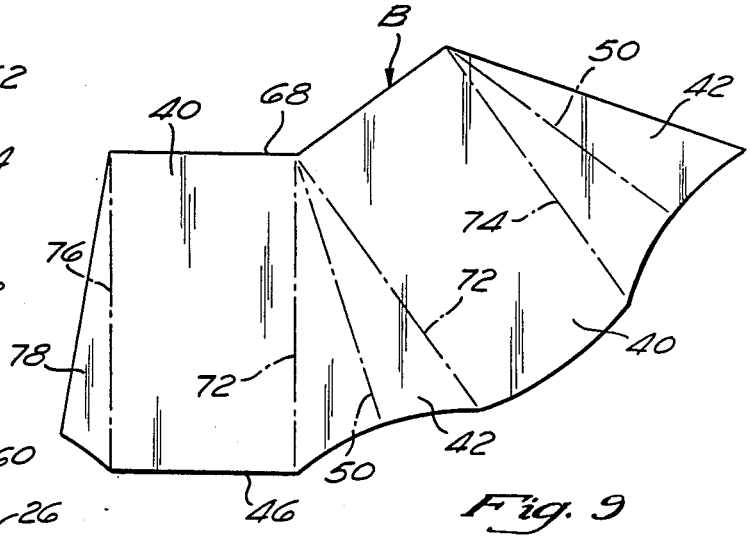
FIG. 9 is a planar view of the blank from which the housing sleeve of the collecting device is formed.
Figure 7:
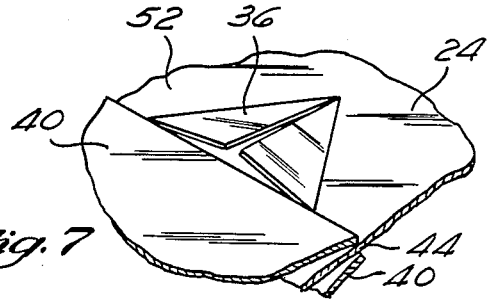
FIG. 7 is an enlarged fragmentary view of the upper face of the device showing a punchout locking mechanism.

The construction details of one embodiment of the device are shown in FIGS. 8 and 9. The body 14 is formed from a blank A of cardboard or similar material having the shape shown in FIG. 8. The housing sleeve 12 is formed from a blank B of cardboard or similar stock material having the shape shown in FIG. 9.

Blank A is formed to include a planar panel 52 defined by upper edges 54, lower edges 56 and by fold lines 38, 58 and 30. Body blank A includes roughly triangular sections 26 which extend from panel 52 on lateral fold line 60. Each roughly triangular section is bisected by a crease line 32.

Blank A is further formed with end sealing flaps 64. Two end sealing flaps 64 are provided, extending from triangular sections 26 at fold line 66. Fold line 30 defines a terminal lip 28. The upper end of blank A optionally has a hole 20 therein. To provide the cooperative locking mechanism of this embodiment, an inverted T-shaped perforation pattern 36 is impressed on the panel 52 just above the point where the upper ends of the triangular sections 26 join the panel 52.

The body 14 formed is illustrated in FIG. 2, folded from body blank A so as to form a scoop 18 with an elongated handle 16. The body is maintained in the assembled condition, shown in FIG. 2, by folding the body blank along lower fold line 58 and lateral fold lines 60 and by securing by glue, paste, or other means the end sealing flaps 64 to edges 56.

Thus, when the body is formed, it has a lower scoop section 18 consisting of a base 22 formed from the lower portion of the planar panel 52, an adjacent middle portion of the planar panel lying between fold lines 38 and 58, two side walls 26 formed from triangular sections 26 by folding along lateral fold lines 60, and the remaining upper section of the planar panel 52 which serves as a handle 16.

Blank B is formed to include two planar portions 40 defined by edges 68 and 46 and by fold lines 72, 74, and 76, together with two triangular panels 42, one center triangular panel 42 lying between planar panels 40 and defined by fold lines 72, and the other end triangular panel 42 extending from a rectangular panel 40 at fold line 74. A triangular end sealing flap 78 extends from a planar panel 40 at fold line 76. Triangular panels 42 are bisected by a crease line 50.

The housing sleeve formed is illustrated in FIG. 2, folded from blank B so as to form a wedge-shaped envelope or housing, open at both ends. The housing sleeve 12 is held in its assembled condition by folding the sleeve blank B along fold lines 72, 74, and 76, by overlapping triangular end sealing flap 78 onto end triangular panel 42 and by securing by glue, paste, or other means triangular end flap 78 to triangular panel 42. Thus, when the housing sleeve 12 is formed it comprises a pair of planar panels 40 joined by triangular gussets 42, the gussets 42 capable of folding inwardly along a longitudinal crease 50 to allow the planar panels 40 to close together and flatten the housing sleeve 12.

Figure 10:
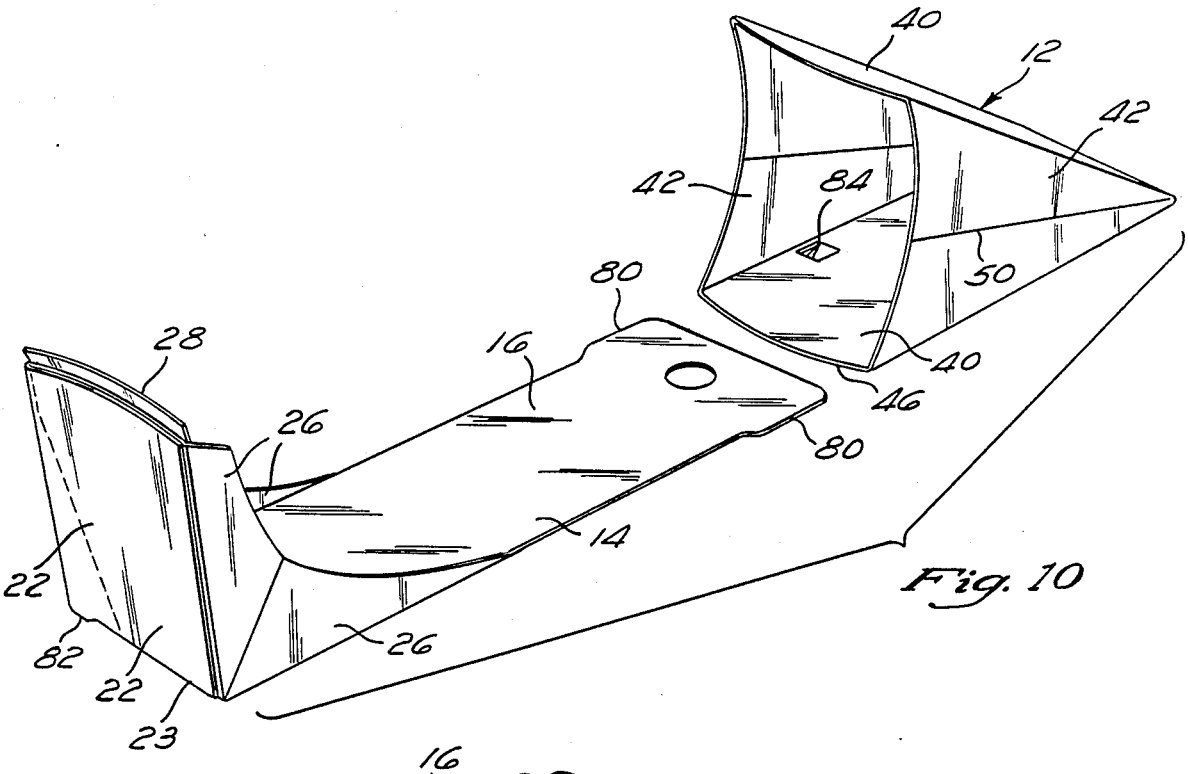
FIG. 10 is an exploded view of an alternate embodiment of the device in a disassembled, unfolded condition.

The design of an alternate embodiment is seen in FIG. 10, and its operation demonstrated in FIG. 11. In this embodiment, the base 22 of the scoop 18 is reinforced with additional layers of blank stock to it more rigid. In this embodiment, the cooperative locking mechanism comprises a tab 82 on the heel 23 of the scoop 18 which automatically holds the scoop 18 in place within housing sleeve 12 by snapping into a window 84 on a planar panel 40 of the housing sleeve 12 when the scoop 18 is drawn within. The operation of this cooperative locking mechanism is shown in FIG. 12 in which the scoop 18 is extended and in FIG. 13 in which the scoop 18 has been drawn up into the housing sleeve 12.

The body 14 of the device in this embodiment is formed from blank A (FIG. 14) modified to comprise end sealing panels 64 of roughly the same dimensions as the scoop base 22. The two end sealing panels 64 are folded over the scoop base 22, and then glued in place. The layers of the base 22 of the scoop 18 may be further secured by an integral interlock 86. A suitable integral interlock 86 for the layers of the base 22 of the scoop 18 may be formed by cutting corresponding profiles 88 in the end sealing panels 64, as shown in FIG. 17. These profiles then engage each other in the folded device as shown in FIG. 18, to secure the end sealing panels 64 and provide support for base 22 of the scoop 18, making it rigid and strong.

The cooperative locking mechanism of this embodiment is formed by extending a tab 82 from one of the end sealing flaps 64 in Blank A (FIG. 14), and by forming a corresponding window 84 in the planar panel 40 of Blank B as shown in FIG. 15.

The use of the collecting device of this inventor is described in terms of its suitability for collecting and containing pet waste; however, it can be used advantageously in any circumstances when it is necessary or desirable to collect material without touching it, either because it is hazardous, contaminating or because it must not be contaminated. Some examples that suggest themselves are the collection of paint-spattered, blood-stained, or oil-soaked debris, broken glass, infectious materials, or specimens collected for forensic examination.

As will be evident to those skilled in the art, modifications of the present invention can be made in view of the foregoing disclosure without departing from the spirit and scope of the invention.

I claim:

1. A disposable, foldable collecting device adapted to collect and contain material, comprising:

a body, comprising a handle and an opposite scoop for collecting said material, said scoop being collapsible and foldable against said handle to form a substantially flat body; and a sleeve, comprising an opening at one end and an opposite mouth, said opening slidably receiving said handle of said body for remote manipulation of said scoop, and said mouth slidably receiving said scoop to form a sealable chamber for containing said material;

said chamber being manipulated by said handle to (i) an open position wherein said scoop is withdrawn from said sleeve to permit the material to be collected by said scoop, and (ii) a closed position whereby said material is drawn into said chamber by said scoop and said handle; and said sleeve being foldable to form a substantially flat sleeve, whereby said collecting device can be easily and compactly transported and stored.

2. The collecting device of claim 1, wherein said scoop further comprises side walls which intersect the edges of said mouth of said sleeve in a scissor-like fashion to contain said material within said chamber while said chamber is being manipulated to said closed position.

3. The collecting device of claim 1, wherein said scoop comprises means for frictionally sealing said chamber when said chamber is in said closed position.

4. The collecting device of claim 3, wherein said frictional sealing means comprises a flexible lip on said scoop, the dimension of said scoop including said lip being slightly larger than the corresponding dimension of said mouth such that said lip is wedged against said mouth when said chamber is in said closed position to form said frictional seal.

5. A disposable, collapsible animal waste collecting device comprising:

a body, comprising:

an elongated panel, comprising upper, middle, and lower sections, said middle and lower sections being joined by a flexible hinge; and side walls extending along the lateral edges of said lower and middle sections, said side walls having substantially the shape of a triangle, wherein the apex of said triangle is coincident with said flexible hinge, whereby said lower section is held extended and erect with respect to said middle section and together with said middle section and said side walls forms a scoop, said side walls being foldable inwardly to allow said lower section to flex toward said middle section and to flatten thereto;

wherein said upper section of said elongated panel forms an integral handle for said scoop formed by said lower and middle sections and said side walls; and a sleeve for housing said body, said sleeve comprising an upper opening, a lower mouth, and a pair of planar panels interconnected by a pair of triangular gussets, said gussets foldable inwardly whereby said sleeve folds substantially flat, said gussets being extensible whereby said sleeve acquires the shape of a wedge, wherein said upper opening comprises a narrow slit and said lower mouth has a width and a height.

6. A device according to claim 1 or claim 5 wherein said handle of said body extends through said opening of said sleeve when said body is housed therein, said handle acting to extend said scoop forward from said sleeve, to manipulate said scoop in the process of collecting waste, and to retract said scoop up into said sleeve.

7. A device according to claim 1 or claim 5 wherein said handle comprises lateral ears, whereby said handle is limited in its forward movement through said sleeve.

8. A device according to claim 5 wherein said lower section of said scoop is joined to a terminal lip by a flexible hinge allowing said lip to fold outwardly from said lower section, whereby said lip wipes the path of the scoop and acts as a friction seal when said scoop is housed in said housing sleeve.

9. A device according to claim 8 wherein said terminal lip of said scoop is curved outwardly.

10. A device according to claim 9 wherein said housing sleeve has a top and a bottom planar surface and wherein the lower edge of said bottom planar surface has a curvature substantially identical to that of said terminal lip.

11. A device according to claim 1 or claim 5 wherein said body and said sleeve are adapted to interlock with one another so that contents are held securely within.

12. A device according to claim 11 wherein a punch-out section on said body engages the upper edge of said sleeve when said handle is inserted therethrough, and acts to restrict relative movement therebetween, thereby locking said body in said sleeve.

13. A device according to claim 11 wherein a punch-out window on a planar panel of said sleeve engages a tab extending from the base of said scoop of said body when said body is retracted into said sleeve.

14. A device according to claim 1 or claim 5 wherein said body and said sleeve are assembled from unitary planar blanks.

15. A device according to claim 1 or claim 5 wherein said body and said sleeve are maintained in an assembled form by integral interlocking structures.

* * * * *